United States Patent [19]

Iten et al.

[11] 4,189,829

[45] Feb. 26, 1980

[54] DUAL PURPOSE CUTTER PACKAGE/GUARD

[75] Inventors: Clemens A. Iten, Staunton; Christopher J. Campbell, Richmond, both of Va.

[73] Assignee: American Safety Razor Company, Verona, Va.

[21] Appl. No.: 913,164

[22] Filed: Jun. 6, 1978

[51] Int. Cl.[2] ..... B26B 29/00; B26B 3/00

[52] U.S. Cl. ..... 30/151; 30/169; 30/286; 206/228; 206/352

[58] Field of Search ..... 30/151, 329, 337, 339, 30/162, 286, 169, 294; 206/352, 353, 354, 228

[56] References Cited

U.S. PATENT DOCUMENTS

| | | | |
|---|---|---|---|
| 2,526,867 | 10/1950 | Hitchcock | 30/162 |
| 2,604,977 | 7/1952 | Murds | 206/353 |
| 3,126,629 | 3/1964 | Claisse | 30/151 |
| 3,362,069 | 1/1968 | Blackwell | 30/151 |
| 3,793,726 | 2/1974 | Schrank | 30/151 |
| 3,899,828 | 8/1975 | Bosco | 30/151 |

*Primary Examiner*—Gary L. Smith
*Assistant Examiner*—Roscoe V. Parker, Jr.
*Attorney, Agent, or Firm*—Gajarsa, Liss & Conroy

[57] ABSTRACT

A cutter/scraper is disclosed having a flexible supporting structure. The support structure incorporates a frangible guard, the latter being reusable to cover the cutting edge subsequent to separation from the support handle. Handle flexibility permits improved scraping operation, and easier gripping is afforded for the cutter. The integral blade guard forms part of the packaging, and permits the visibility of the cutting edge while safely protecting from the effects thereof. The apparatus is formed of a single, inexpensive molded piece of plastic, thereby making the cutter/scraper disposable after having served its purpose.

19 Claims, 4 Drawing Figures

DUAL PURPOSE CUTTER PACKAGE/GUARD

BACKGROUND OF THE INVENTION

1. Field of the Invention

The present invention relates to cutters and scrapers, and more particularly to such devices having a dual purpose guard, preferably integral with a handle portion and forming a part of the apparatus packaging unit.

2. Description of the Prior Art

Cutters and scrapers which possess reusable guards for the cutting edges thereof are known. U.S. Pat. No. 3,362,069 to Blackwell discloses, for example, a packaging means for a razor including two (2) portions, one such portion acting as a razor guard. The apparatus is bulky, however, is produced in several pieces rather than a single piece, and requires assembly for utilization. A component which may be used either for holding or guarding a blade is disclosed in Bosco U.S. Pat. No. 3,899,828. Schrank U.S. Pat. No. 3,793,726 teaches a disposable scalpel, having a frangibly detachable guard. However, once removed, reuse of the guard is made difficult by a retainer bar forming a narrow slot for blade insertion. The guard is, in fact, never used after separation, except for blade coverage upon disposal. Hitchcock U.S. Pat. No. 2,526,867 typically discloses a holder for a single edge cutter, the holder being separately formed and not being frangible from the remaining cutter packaging. Muros U.S. Pat. No. 2,604,977 discloses the use of a score line in conjunction with a multiple blade package, but fails to provide an easily disposable, flexible, one piece package for a single blade.

The present invention overcomes the disadvantages of the prior art and provides a single element cutter handle/package and guard for a cutter and/or scraper, thereby enhancing safety features of such a device and providing for easy manufacture, packaging and distribution thereof.

SUMMARY AND OBJECTS OF THE INVENTION

The present invention teaches a one piece, breakaway razor blade package and guard. The packaging may be formed in a single molding operation, and incorporates a score line for separation of a guard portion from a handle portion. The separated guard further includes gripping means for the blade, thereby acting to provide protection for various objects and personnel from inadvertent contact with the sharp cutting blade.

An additional safety feature is provided in the present invention by the easy visibility of the blade, whether in its initially packaged portion, with the guard attached to the handle, or in its "covered" position after use and separation of the guard from the handle. Ready visibility of the cutting blade serves as a warning to observers that a sharp instrument is present, and that proper precautions need to be taken in its manipulation.

As a further feature of the invention, the combined handle and dual purpose guard form a flat package, whereby a plurality of such devices may readily be stacked for convenient packaging and shipping.

The utilization of a plastic material for the handle and guard further provides a flexible package and handle for a scraper, thereby enhancing its utility. Moreover, a plurality of gripping means are provided for maintaining the guard in frictional contact with the blade, the plurality of such means providing for added safety by preventing disengagement of the guard from the blade upon breakage or disablement of a single one of such means. The gripping means are further selected to provide ease of insertion of the blade edge therein, thereby further enhancing the safety characteristics of the device.

Means are further provided upon the package for facilitating mounting of a blade on the scraper handle and guard, and for securely locking the blade in contact with the handle.

Accordingly, it is a principal object of the present invention to overcome the deficiencies of the prior art and to provide an improved cutter and scraper.

Another object of the invention is an improved cutting means having additional safety features.

Yet another object is the provision of a single element handle and guard for a cutting means.

An additional object is the provision of a packaging means for a cutter having a frangible portion thereof separately reusable as a guard for the cutter.

It is a further object of the invention to provide a packaging handle and reusable guard means for a cutter which permits easy packaging of a plurality of such devices.

Yet a further object is the provision of a packaging-/handle/guard means formable in a single molding operation.

Still another object of the invention is the incorporation of a score line in a packaging means for a cutter/-scraper, whereby a portion of said packaging means may be reused as a guard for the blade.

An additional object of the invention is the provision of gripping means within a guard for a razor/scraper, said gripping means being integrally formed with the guard.

A further object is the provision of a plurality of redundant gripping means in a guard for a blade, thereby enhancing the safety characteristics of the device.

Another object of the invention is the enhancement of the safety of utilization of a cutter or scraper by enabling visibility of the blade even when guarded.

Still another object of the invention is the provision of mounting means on a handle for a cutter for a blade to be applied thereto.

Yet another object is the alternation of long and short fingers in the gripping means associated with a guard for a razor containing cutter, whereby engagement of the blade by the guard is enhanced.

Still another object is the provision of a flexible handle for a scraper, thereby enhancing operation of the device as a scraper.

Another object of the invention is the provision of gripping means in a handle for a cutter and/or scraper.

Yet another object of the invention is the provision of second gripping means on a guard for a cutter blade, whereby lateral movement of the guard in a direction parallel to the blade edge is prevented.

Other objects, features and advantages of the present invention will become more readily apparent from the following specification and appended claims, when read in conjunction with the attached drawings.

DETAILED DESCRIPTION OF A PREFERRED EMBODIMENT

Figure 1:
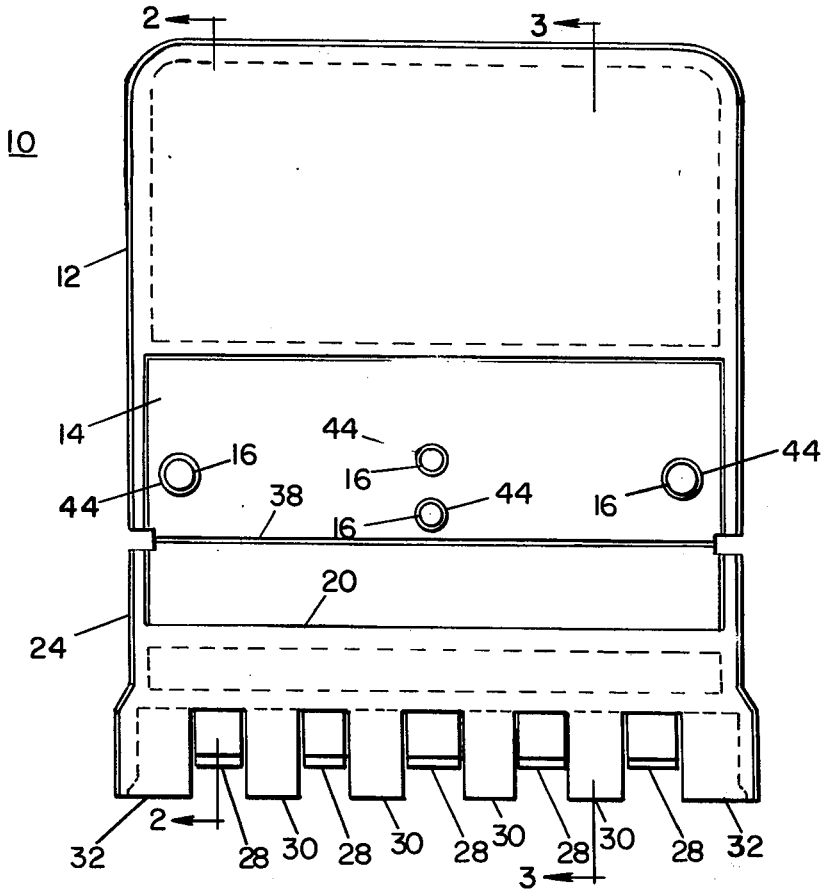
FIG. 1 is a view of the present invention from the blade containing surface thereof.

Referring now to FIG. 1, a scraper and/or cutter is shown at 10, comprising a handle portion 12 for blade 14 mounted thereon by mounting pins 16.

Handle 12 includes an indentation, or recess 18, advantageously adapted for receiving therein blade 14. The recessed portion 18, better seen in FIG. 2, retains the blade therein, with the keen edge thereof, shown at 20, protected by bottom wall 22 of recess 18.

Handle 12 is preferably, but not exclusively, made of a plastic material, for ease in manufacture. The unit, as seen in FIG. 2, presents a slim, compact, flat packaging cross section, and thus provides for ease in packaging a plurality of such devices for shipment.

Figure 4:
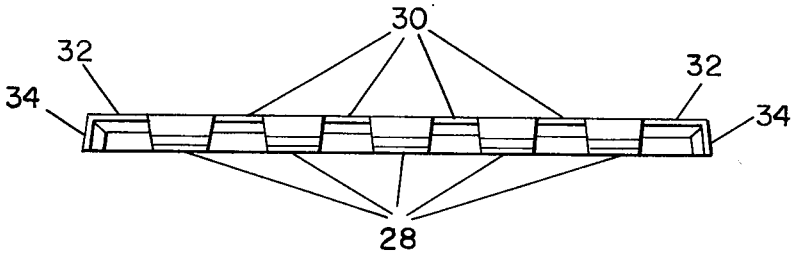
FIG. 4 is a view of the invention taken along line 4—4 in FIG. 1.

Handle 12 further includes a bottom portion 24, comprising a plurality of interdigitated fingers 26. As will hereinafter be described, the fingers 26 are arranged in an alternating sequence of short and long fingers, 28 and 30, respectively. As is apparent from FIG. 4, the short and long fingers are disposed at the back and the front faces of the portion 24, through an opposite arrangement is equally useful. As is also apparent from FIG. 4, end fingers 32 comprise angled portions 34 associated therewith. It is appreciated that the blade 14 may have a curved, a linear, a non-linear, or a curvilinear shape and that said interdigitated fingers may be arrayed in a similar curved, linear, non-linear, or curvilinear shape thus providing frictional retention and protection of the blade. End fingers may be provided with such shapes as well as the standard straight line edge blade.

Figure 2:
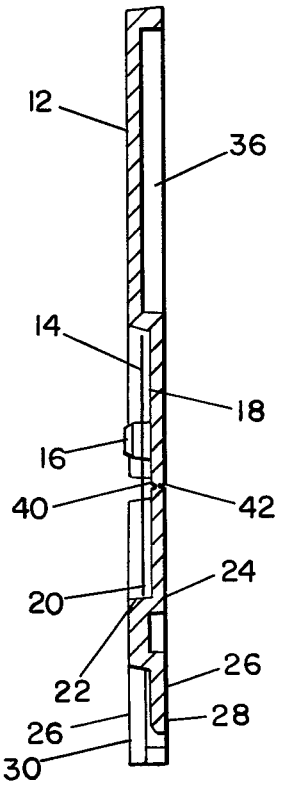
FIG. 2 is a view of the invention taken along section line 2—2 in FIG. 1.
Figure 3:
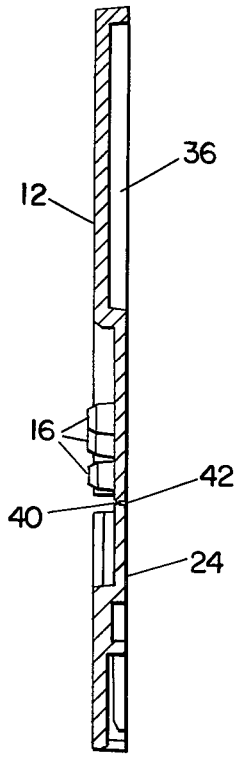
FIG. 3 is a view of the invention taken along section line 3—3 in FIG. 1.

Referring now to FIGS. 2 and 3, the handle 12 is seen to contain a second indented recess 36 at the backside thereof.

Finally, a score line 38 is seen to separate bottom portion 24 of handle 12 from the remainder of the apparatus. The score line may be formed in any of the known techniques, and may advantageously include score lines 40 and 42, on the front and back portions of the handle, respectively.

The disclosed apparatus is extremely simple and inexpensive to manufacture, requiring production of but a single piece, such as by injection molding for example. Having produced the handle with its bottom portion, blade 14, having openings 44 therein, is mounted on the handle, pins 16 being used to register the blade by insertion in and projection through openings 44. Accordingly, blade mounting is simplified by provision of pins 16 in the handle. After mounting, pins 16 may be staked or otherwise expanded to retain blade 14 permanently on handle 12. The simplified fabrication and mounting techniques provide an inexpensive product which may easily be discarded after use, such that any technique may be employed to provide for a rigid mounting of the blade on the handle. Conceivably, the blade may be mounted without the use of pins and may be bonded onto the handle.

Recess 18, having been chosen to accommodate blade 14, accordingly now covers edge 20 with wall 22, thereby protecting the keen edge of the blade until its use is required.

Similarly, users and other objects are protected from the consequences of exposure to a keen blade edge.

When it is desired to use the presently described invention, one may advantageously utilize score line 38 by bending bottom portion 24 counterclockwise about said score line, as viewed in FIG. 2. Use of material, such as high impact styrene, for the handle assures that inadvertent rotation of the bottom portion about the score line will not take place, and that the keen edge of the blade will remain covered until its use is desired.

Indentation 36 on the back face of handle 12 provides for a thin, flexible handle for use with the scraper, thereby permitting more flexible action and improved scraping ability on the art of the invention. Additionally, recess 36 provides for easier gripping of the handle and reduces the likelihood of slippage thereof.

Insertion of razor blade 14 in recess 18 on the front face of the handle provides ready visibility of the blade in its packaged form, and easy identification of the product, as well as of the precautionary measures which must be taken in conjunction therewith.

Having utilized the blade as intended, the bottom portion 24 may now be reused in a dual role of a guard, or sheath for the blade. Specifically, by rotating guard portion 24 so that fingers 28 and 30 point upwardly, the fingers may be made to engage blade edge 20 therebetween. The use of a plurality of fingers 28 in conjunction with a plurality of fingers 30 advantageously provides for redundancy in the gripping means retaining the guard portion in frictional contact with blade 14. Such redundancy provides added safety measures, thus assuring that the guard will stay mounted on the blade even in the event of malfunctioning of one or more of the fingers. Further, the interdigitation of long and short fingers, the long fingers being to one side of the guard and the short fingers disposed toward the other side, provides for easy insertion of the blade into the fingers. Specifically, if fingers 28 and 30 were of the same length, then a slot would be presented for insertion of the blade edge 20. Insertion of the blade into such a slot would require some manipulation. By providing fingers of differing lengths on either side of the blade retaining opening provided by the fingers, the user is presented with a much larger area for initial insertion of the blade, and is enabled to insert the blade into the guard more easily and with less manipulation, thus lessening hazard of slippage and possible cutting.

As has previously been described, end fingers 32 include angled portions 34. As can be appreciated from the preceding description, insertion of the blade between fingers 28 and 30, which effectively shields the blade edge and provides protection therefor and therefrom, nonetheless permits the blade to move laterally with respect to the fingers. Such movement might then expose a portion of the blade, even though the major portion of the edge were still covered. Portions 34 of fingers 32 prevent such lateral motion of the blade, and thus provide yet additional safety features to the disclosed invention.

From the preceding description, it is thus appreciated that the present invention provides, inter alia, a dual purpose guard unit for a razor blade, acting in conjunction with a handle to provide both a packaging means for the blade and a guard or cover therefor. The disclosed invention incorporates several safety features, as well as features providing improved use as a scraper. Moreover, the inventive apparatus is inexpensive to manufacture, and provides a compact structure, easily stacked for shipping in multiple quantities.

The preceding specification describes, by way of illustration and not limitation, a preferred embodiment of the invention. Equivalent variations of the described embodiment will occur to those skilled in the art. Such variations, modifications, and equivalents are within the scope of the invention as recited with greater particularity in the following claims, when interpreted to obtain benefits of all equivalents to which the invention is fairly entitled.

I claim:

1. In a packaging means for a blade having a keen edge, an element comprising:

(a) a handle portion, (b) a second portion connected to said handle portion, (c) said second portion being frangibly connected to said handle portion, (d) said second portion comprising first means for protecting said keen edge while frangibly attached to said handle portion and forming a part of said packaging means, (e) said second portion further comprising first and second sets of teeth for gripping said blade after detaching said second portion from said handle portion, (f) said first and second sets of teeth being arrayed along opposing faces of an edge of said second portion, for providing frictional gripping of said blade therebetween.

2. Apparatus as recited in claim 1 wherein said first means for protecting comprises means for containing said keen edge.

3. Apparatus as recited in claim 2 wherein said means for containing comprises an indented section of said second portion.

4. Apparatus as recited in claim 3 wherein said indented section extends continuously to one edge of said second portion.

5. Apparatus as recited in claim 1 wherein said first and second sets of teeth comprise means for containing said keen edge.

6. Apparatus as recited in claim 1 wherein said first and second sets of teeth are disposed along a first edge of said second portion.

7. Apparatus as recited in claim 6 wherein said first means for protecting comprises an indented section of said second portion along a second edge of said second portion.

8. Apparatus as recited in claim 1 wherein said first and second sets of teeth comprise interdigitated fingers of varying height, whereby easier insertion of said keen edge in said sets of teeth is achieved.

9. Apparatus as recited in claim 1, said first and second sets of teeth being arrayed in a shape matching the shape of the keen edge of said blade.

10. Apparatus as recited in claim 1 further comprising gripping means for preventing displacement of said keen edge in a direction longitudinal with respect to said edge.

11. Apparatus as recited in claim 10 wherein said gripping means for preventing comprises edge fingers having angled portions depending therefrom.

12. Apparatus as recited in claim 1, said handle means being flexible for enabling easy operation of said cutter as a scraper.

13. Apparatus as recited in claim 12, said handle means comprising an indented portion to facilitate gripping thereof and to enhance handle flexibility for scraping operation.

14. Apparatus as recited in claim 1, said element further comprising means for displaying said blade, whereby users are reminded of the keen edge thereon and safety in operation is enhanced.

15. Apparatus as recited in claim 14 wherein said displaying means comprises a first indentation in said handle means cooperating with a second indentation in said second portion for protecting said keen edge prior to separation of said handle and said second portion, and for concurrently displaying said keen edge.

16. Apparatus as recited in claim 1 wherein said handle portion and said second portion are integrally formed in a flat element.

17. Apparatus as recited in claim 16, said handle portion comprising mounting means for said blade thereon.

18. Apparatus as recited in claim 17, said mounting means being integrally formed with said handle portion and comprising means cooperating with other means on said blade.

19. Apparatus as recited in claim 18, wherein said cooperating means comprises mounting pins, and said other means comprises perforations formed in said blade.

* * * * *